US005979333A

United States Patent [19]

Houben et al.

[11] Patent Number: 5,979,333

[45] Date of Patent: Nov. 9, 1999

[54] AMUSEMENT DEVICE AND VEHICLE SUITABLE FOR BEING USED IN SUCH AN AMUSEMENT DEVICE

[75] Inventors: Jacob H. M. Houben, Maaseik, Belgium; Petrus J. H. Clerx, Roermond, Netherlands

[73] Assignee: Verkoma Technology, B.V., Vlodrop, Netherlands

[21] Appl. No.: 09/003,254

[22] Filed: Jan. 6, 1998

[30] Foreign Application Priority Data

Jul. 19, 1995 [NL] Netherlands ..... 100774

[51] Int. Cl.[6] ..... A63G 1/00

[52] U.S. Cl. ..... 104/63; 104/89; 104/93; 105/148; 105/150

[58] Field of Search ..... 104/53, 55, 56, 104/62, 63, 64, 85, 89, 91, 93; 105/148, 150

[56] References Cited

U.S. PATENT DOCUMENTS

| | | | |
|---|---|---|---|
| 4,004,654 | 1/1977 | Hamy | 105/149 |
| 5,224,425 | 7/1993 | Remington | 104/53 |
| 5,272,984 | 12/1993 | Bolliger et al. | 104/63 |
| 5,372,072 | 12/1994 | Hamy | 105/150 |

FOREIGN PATENT DOCUMENTS

| | | |
|---|---|---|
| 0 545 860 A1 | 11/1992 | European Pat. Off. . |
| 3237684A1 | 4/1983 | Germany . |
| WO 96/22821 | 8/1996 | WIPO . |

*Primary Examiner*—Christopher P. Schwartz
*Assistant Examiner*—Robert J. McCarry, Jr.
*Attorney, Agent, or Firm*—Skjerven, Morrill, MacPherson, Franklin & Friel LLP; Alan H. MacPherson

[57] ABSTRACT

An amusement device includes a guide structure forming an endless track, along which a vehicle capable of accommodating at least one person can travel, and where a person present in the vehicle extends substantially parallel to the track during operation. The person present in the vehicle lies with his back towards the track and with his face directed away from the track. The person's view is not impeded by other vehicles and he can only see the track itself when he turns his head.

10 Claims, 5 Drawing Sheets

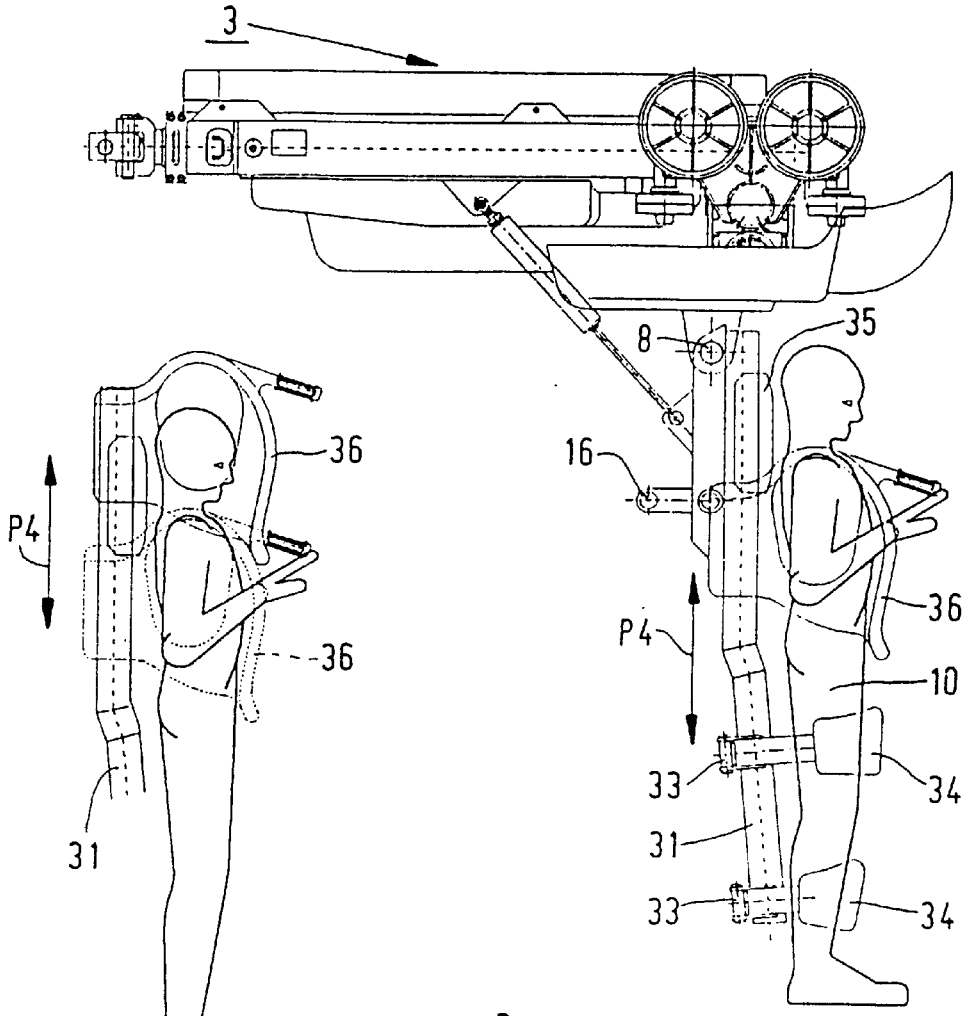
FIG. 6B
FIG. 6A
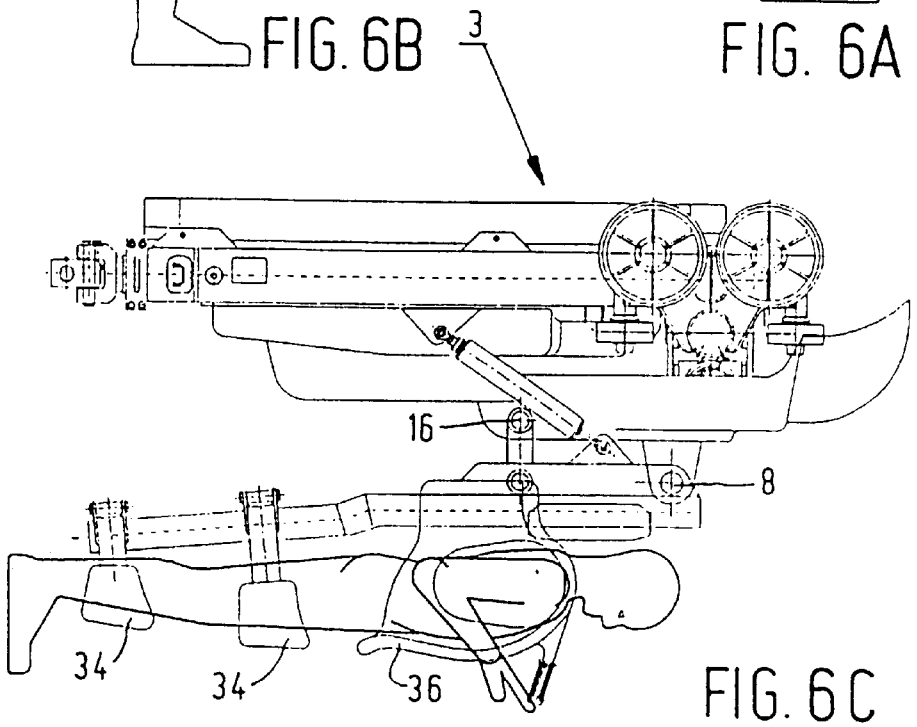
FIG. 6C

AMUSEMENT DEVICE AND VEHICLE SUITABLE FOR BEING USED IN SUCH AN AMUSEMENT DEVICE

The invention relates to an amusement device comprising a guide structure forming a track, along which a vehicle capable of accommodating at least one person can travel, whereby a person present in the vehicle during operation extends substantially parallel to the track.

By such a device, which is known from U.S. Pat. No. 5,224,425, the person must take up himself a prone position at the embarking station and get up himself from the prone position at the disembarking station. This has the disadvantage that the embarking/disembarking is not very comfortable and time consuming.

The object of the invention is to provide an amusement device whereby the above drawbacks are avoided.

This objective is accomplished with the amusement device according to the invention, in that a part of the vehicle which supports said person can be tilted from a first position, in which the person present in the vehicle during operation includes an angle with the track, to a second position, in which the person present in the vehicle during operation extends substantially parallel to said track.

As a result of this it is possible to have said person include an angle with the track along certain parts of the track, for example when getting in, in order to facilitate said getting in, whilst said person is moved to a position extending parallel to the track after getting in.

The person present in the vehicle lies with his back towards the track and with his face directed away from the track. Said person's view is not impeded by other vehicles and he can only see the track itself when he turns his head. The person in question has a sensation of flying and being some kind of superman. Of course the person's face may also be directed towards the track, but this is less spectacular.

It has to be noted that with an amusement device known from U.S. Pat. No. 5,272,984 a person is seated in a vehicle, whereby said person looks at other vehicles travelling along the track. This leads to a reduced sensation of excitement, since said person is already able to see the movements of the vehicles ahead of him and on the basis of that knows what to expect.

Another embodiment of the amusement device according to the invention is characterized in that said vehicle is suspended from said guide structure.

The person present in a vehicle during operation thereby looks down when the track extends horizontally and is given a sensation of flying.

The invention will be explained in more detail hereafter with reference to a drawing, in which:

FIGS. 3 and 4 are plan views of a part of the vehicle shown in FIG. 2, which respectively show said vehicle in the position it occupies when said person gets in and in the position it occupies after said person has got in;

FIGS. 6A–6C show a third embodiment of a vehicle according to the invention; and FIGS. 7A–7C show a fourth embodiment of a vehicle according to the invention.

Like parts are numbered alike in the various Figures.

Figure 1:
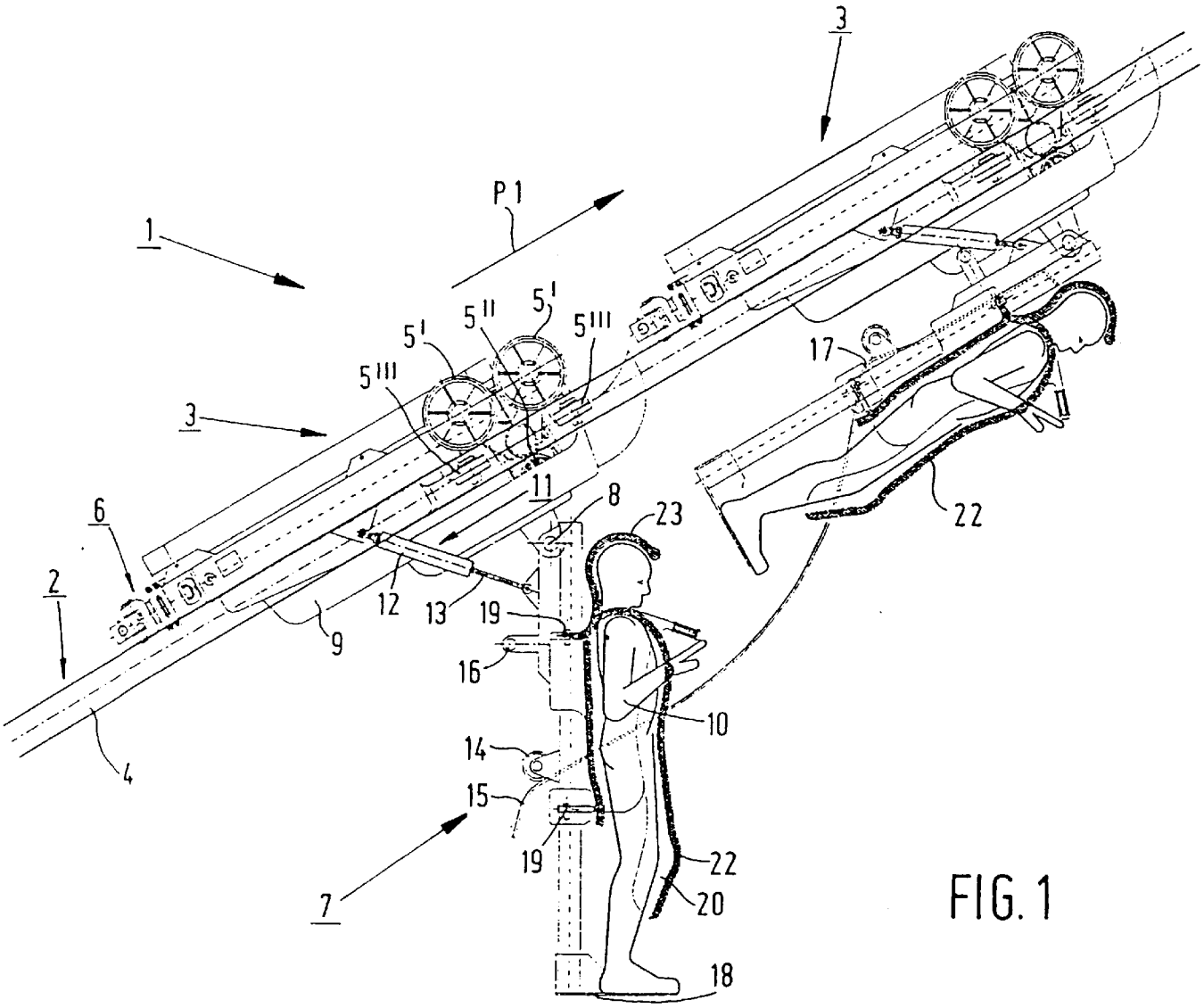
FIG. 1 is a side view of an amusement device according to the invention.

FIG. 1 shows an amusement device 1 according to the invention, which comprises an elongated guide structure 2 forming an endless track and vehicles 3 being movable along said guide structure 2. The elongated track for example comprises loopings, spirals, helical track parts and so-called side winders. Guide structure 2 comprises at least two parallel tubes 4, on which wheels 5', 5", 5'" secured to vehicle 3 roll. On one side facing away from the wheels said vehicle 3 is provided with a coupling element 6, which can be coupled to a support (not shown) located between the tubes 4. It is known per se to guide a vehicle 3 over tubes 4 in this manner, for example from the aforesaid US patent U.S. Pat. No. 5,272,984.

Vehicle 3 is provided with a part 9, which is movable over guide structure 2, and a part 7 which can tilt about a pin 8 with respect to part 9. A person 10 will be present on part 7 during operation. Part 7 is connected to part 9 by means of a shock absorber 11. Shock absorber 11 comprises a cylinder 12 and a piston 13 being movable within said cylinder, whereby cylinder 12 and piston 13 are pivoted to part 9 and part 7 respectively. Due to the presence of shock absorber 11 the tilting movements of part 7 with respect to part 9 take place gradually. Part 7 can be tilted from a first, vertical position to a second position, in which the person 10 present in part 7 extends substantially parallel to guide structure 2, as is shown in the right-hand part of FIG. 1. Part 7 is provided with a wheel 14, which during movement of vehicle 3 in the direction of transport indicated by arrow P1 comes into contact with a guide track 15, which occupies a predetermined position with respect to said guide structure. Wheel 14 rolls on guide track 15, as a result of which part 7 is tilted about pin 8 from said first position to said second position. A locking cam 16 provided on part 7 then comes into contact with a locking mechanism (not shown) provided in part 9, as a result of which part 7 is locked in said second position with respect to part 9. Guide track 15 comprises a slope 17 facing guide structure 2, by means of which said locking cam 16 is pressed firmly into said locking mechanism.

Figure 3:
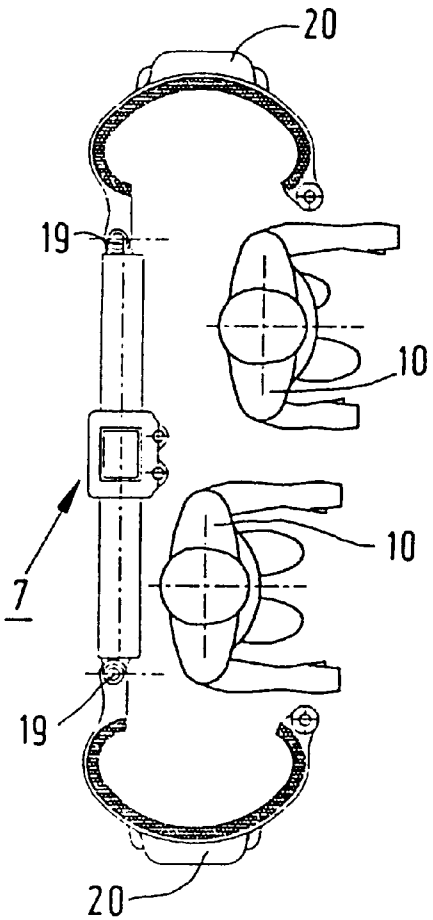
Figure 4:
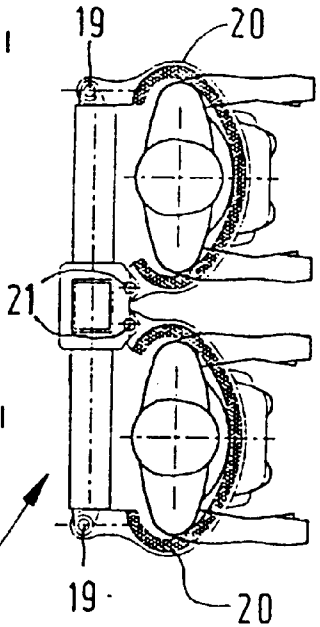
Figure 2:
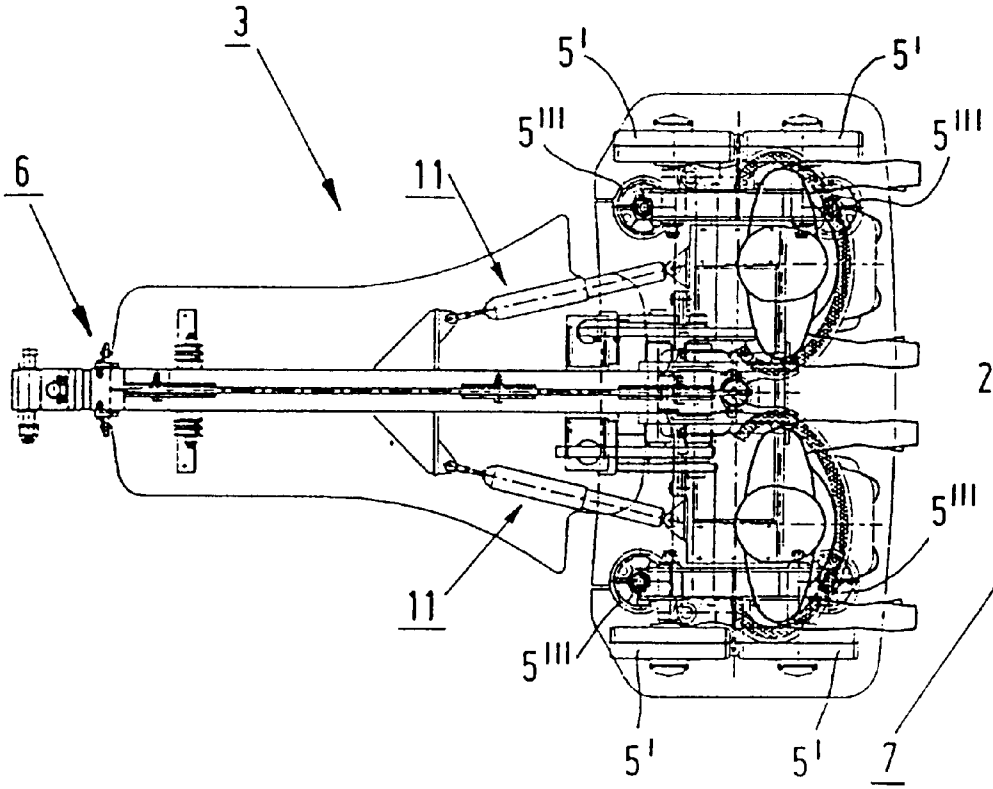
FIG. 2 is a plan view of a vehicle of the device shown in FIG. 1.

Part 7 is provided with a foot platform 18, on which two persons can stand side by side. Part 7 is furthermore provided with two supports 20, which can pivot about pins 19 from an open position shown in FIG. 3 to a closed and locked position shown in FIG. 4. Said pivoting of the supports 20 may be carried out by hand or by means of a motor. In their closed position supports 20 are locked with respect to part 7 by means of a locking mechanism 21 known per se, as a result of which a person 10 present in vehicle 3 cannot undesirably fall out of vehicle 3. Support 20 is provided with a supporting cushion 22 extending along the trunk of person 10, on which cushion said person 10 will lie comfortably when part 7 occupies a sloping or a horizontal position. Support 20 can move with respect to foot platform 18, so that support 20 can be adjusted in dependence on the length of person 10. Part 7 is furthermore provided with a head protector 23, which supports the head of person 10 when relatively large acceleration forces occur during the movement of the vehicle along the track.

Figure 5A:
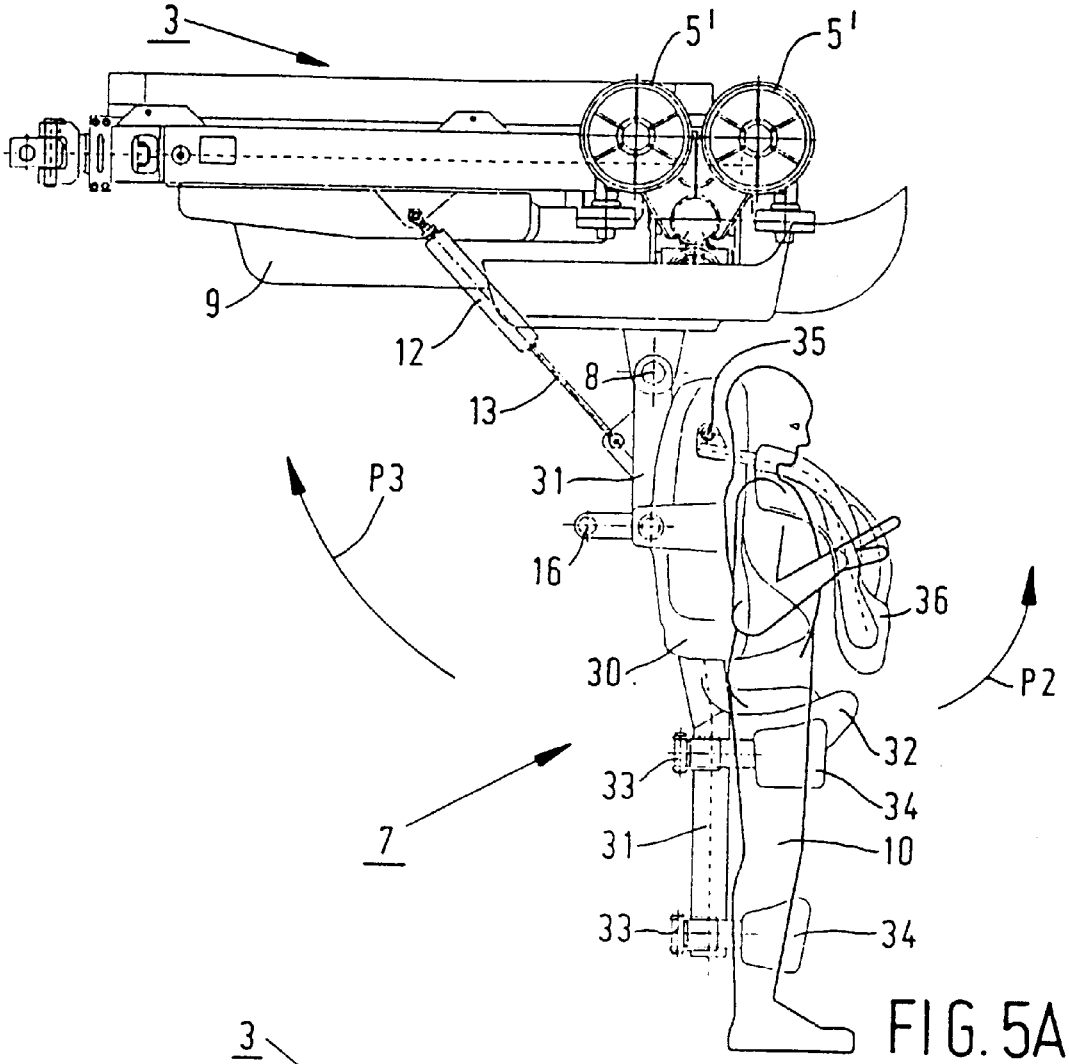
FIGS. 5A and 5B show a second embodiment of a vehicle according to the invention.
Figure 5B:
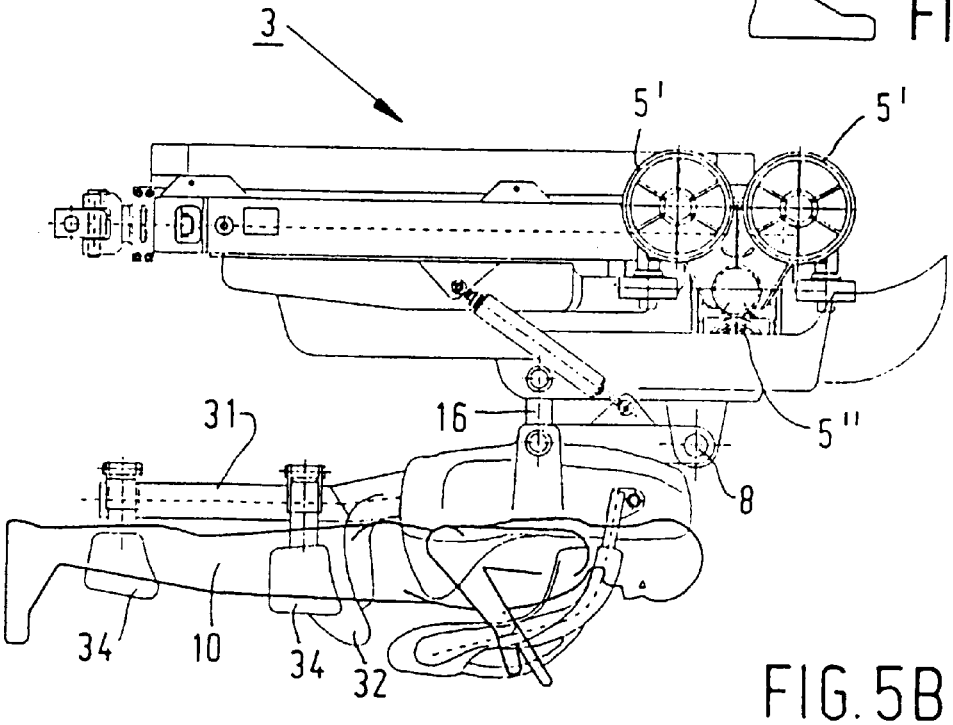

FIGS. 5A and 5B show a second embodiment of a vehicle 3 according to the invention. Part 7 of vehicle 3 is provided with a back-supporting bucket 30, which is connected to a frame 31, which is capable of tilting movement about pin 8 with respect to part 9. Frame 31 furthermore comprises a saddle 32 and two leg supports 34, which is pivotable about pins 33. Bucket 30 is provided with a shoulder and chest support 36, which pivot about a pin 35 in a direction indicated by arrow P2. When person 10 gets in he will seat himself on saddle 32, after which said shoulder and chest support 36 is pivoted in a direction opposite the direction indicated by arrow P2. The leg supports 34 are pivoted about pins 33 and placed round the legs of person 10. Both support 36 and supports 34 are locked in position, so that person 10 cannot undesirably get out of vehicle 3. Then frame 31 is tilted about pin 8 in a direction indicated by arrow P3 and locked in position with respect to part 9 by means of locking cam 16, whereby person 10 extends parallel to the guide structure extending between wheels 5', 5'', 5'''.

FIGS. 6A–6C show a third embodiment of a vehicle 3 according to the invention. Vehicle 3 comprises a frame 31 which can tilt about a pin 8, said frame being provided with a headrest 35, two leg supports 34 being pivotable about pins 33, and a shoulder and chest support 36 being movable in a direction indicated by arrow P4.

Figure 7A:
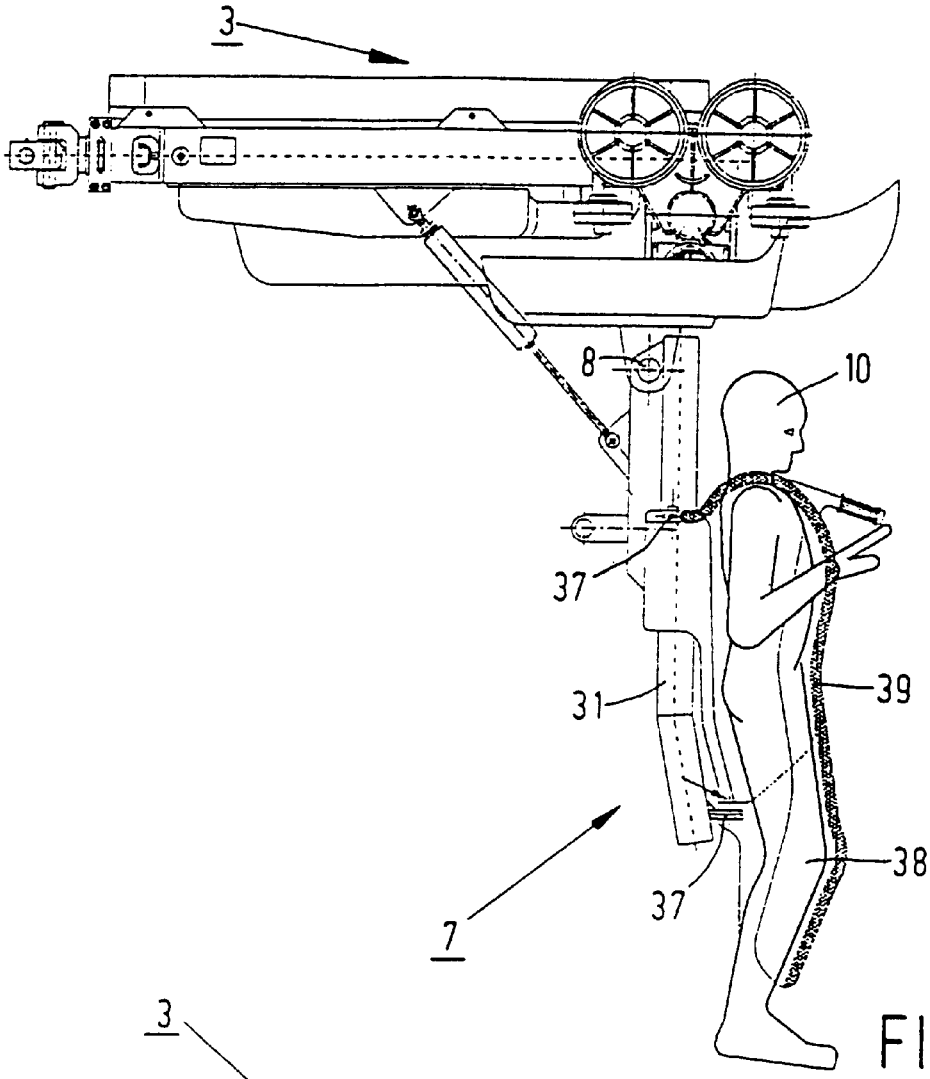
Figure 7B:
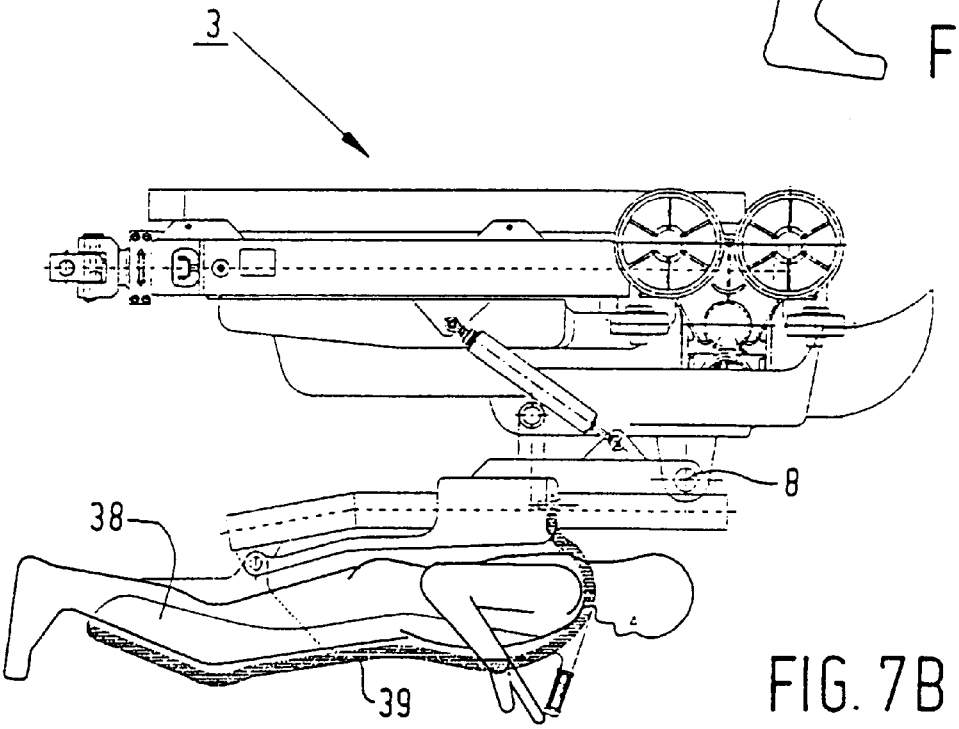

FIGS. 7A and 7B show a fourth embodiment of a vehicle according to the invention. Frame 31 of part 7 of vehicle 3 comprises a support 38 being pivotable about pins 37 and being provided with a supporting cushion 39. Support 38 engages around the shoulders, the trunk and the legs of a person 10 present in vehicle 3.

Instead of providing wheel 14 and guide track 15 it is also possible to provide an electrically, pneumatically or hydraulically driven cylinder between part 7 and part 9, by means of which part 7 can be tilted with respect to part 9.

What is claimed is:

1. An amusement device (1) comprising:

a guide structure (2) forming a track having at least one sloping portion; and a vehicle (3) movable along the track, the vehicle including a first part (9) and a second part (7), the first part coupled to and movable along the track, the second part pivotally connected to the first part and capable of accommodating at least one person, the second part being tiltable between a first position, in which a person in the vehicle is at an angle to the track, and a second position, in which the person in the vehicle extends substantially parallel to the track;

whereby the person present in the vehicle extends substantially parallel to the track as the vehicle moves along the at least one sloping portion.

2. An amusement device according to claim 1, characterized in that said vehicle (3) is suspended from said guide structure (2).

3. An amusement device according to claim 2, characterized in that the second part of the vehicle supporting the person is tilted from said first to said second position by means of a wheel mounted on said second part, which wheel is rollable on a guide track coupled to said guide structure.

4. An amusement device according to claim 3, characterized in that said vehicle includes a lock for securing the second part in said second position.

5. An amusement device according to claim 4, characterized in that said vehicle is provided with a foot platform and with a support which is movable with respect to said foot platform, which support is securable around the person during operation.

6. An amusement device according to claim 5, characterized in that said support comprises a supporting cushion covering substantially an entire trunk of the person.

7. An amusement device according to claim 6, characterized in that said vehicle is provided with a head protector for the person.

8. An amusement device comprising:

a guide structure forming a track having at least one sloping portion;

a vehicle movable along the track, the vehicle including a first part and a second part, the first part coupled to and movable along the track, the second part pivotally connected to the first part and capable of accommodating at least one person, the second part being tiltable between a first position, in which a person present in the vehicle during operation is at an angle with the track, and a second position, in which the person present in the vehicle during operation extends substantially parallel to said track;

a guide track coupled to the guide structure, the guide track being spaced apart from the track of the guide structure; and a wheel mounted on said second part of the vehicle and engaging the guide track, the wheel being rollable along the guide track to tilt the second part from the first position to the second position.

9. An amusement device according to claim 8 wherein said vehicle further includes a foot portion having leg supports pivotal around the legs of the person to support the person's legs in said second position.

10. An amusement device according to claim 8 further including a person shoulder and chest support for supporting the person in the second position, said shoulder and chest support being pivotable and lockable to prevent egress of the person from the vehicle in the second position.

* * * * *